US005265784A

United States Patent [19]

Gregory

[11] Patent Number: 5,265,784

[45] Date of Patent: Nov. 30, 1993

[54] CARRYING SACK FOR A MOTORCYCLE HELMET

[76] Inventor: Michael Gregory, P.O. Box 6246, Beverly Hills, Calif. 90212

[21] Appl. No.: 925,997

[22] Filed: Aug. 6, 1992

[51] Int. Cl.[5] ..... A45C 13/30

[52] U.S. Cl. ..... 224/205; 224/202; 150/118; 294/149

[58] Field of Search ..... 224/205, 202, 206, 207, 224/919, 254, 255; 383/8, 24, 71, 98; 294/149, 152, 153, 154, 155, 156, 157; 150/118; 206/315.9, 315.91

[56] References Cited

U.S. PATENT DOCUMENTS 1,904,729 4/1933 Hancock et al. ..... 224/205

5,048,734 9/1991 Long ..... 224/228

*Primary Examiner*—Henry J. Recla

*Assistant Examiner*—David J. Walczak

*Attorney, Agent, or Firm*—Joseph E. Mueth

[57] ABSTRACT

A novel protective carrying sack for a motorcycle helmet having a generally hemispherical shape, comprising a pliable fabric body having a soft inside surface adapted to polish the surface of the helmet and an outer surface tougher than the inside surface. The fabric body generally conforms to the shape of the shell of the motorcycle helmet and has opposed side flaps which overlap at the top over the helmet to form a closure and also has at one upper end an elongated belt first loop portion. At the opposite upper end is a small second loop portion. The first loop portion is adapted to pass through the second loop portion, and the first loop portion being large enough to pass over the shoulder and under the arm of a wearer when being carried.

3 Claims, 3 Drawing Sheets

CARRYING SACK FOR A MOTORCYCLE HELMET

FIELD OF INVENTION

The invention pertains to a protective carrier for motorcycle helmets.

BACKGROUND OF THE INVENTION

The use of motorcycle helmets is now mandated by law in many jurisdictions and this trend appears likely to continue. The motorcycle helmet itself has become increasingly sophisticated in its construction. The outer shell, the protective inner lining materials and the face shield have all undergone significant design changes and improvement over the years. As a result, and for esthetic reasons as well, the motorcycle helmet is now a fairly costly item, making its care and security a matter of growing interest to the motorcyclist-owner. In addition, driver comfort and safety considerations dictate that the optical clarity of the face shield be preserved against scratching and chipping.

All of the foregoing developments and considerations call for improved means for the protection of the physical integrity of motorcycle helmets and for ways of better maintaining security against theft and loss.

The present invention presents a novel, useful and practical means for providing increased protection of motorcycle helmets against physical damage and theft when not in use.

It is sincerely believed that the present invention is deserving of a patent.

SUMMARY OF INVENTION

A novel protective carrying sack for a motorcycle helmet comprising a pliable fabric body having a soft inside surface adapted to polish the surface of the helmet and a tougher outer surface, said body generally conforming to the shape of the shell of the motorcycle helmet and having opposed side flaps which overlap at the top over the helmet to form a closure and having at one upper end an elongated belt first loop portion, and at the opposite upper end a small second loop portion, said first loop portion being adapted to pass through said second loop portion, and said first loop portion being large enough to pass over the shoulder and under the arm of a wearer when being carried.

It is an object of this invention to provide a new means for carrying a motorcycle helmet.

It is also an object of the invention to provide a carrying sack for a motorcycle helmet which is protective and adapted to be carried over the wearer's shoulder.

It is a related object of this invention to provide novel means for maintaining the security of a motorcycle helmet against loss and theft.

These and other objects and advantages of this invention will be apparent from the more detailed description which follows, particularly when taken with the accompanying drawings.

DESCRIPTION OF THE PREFERRED EMBODIMENT

Turning to the drawings.

Figure 1:
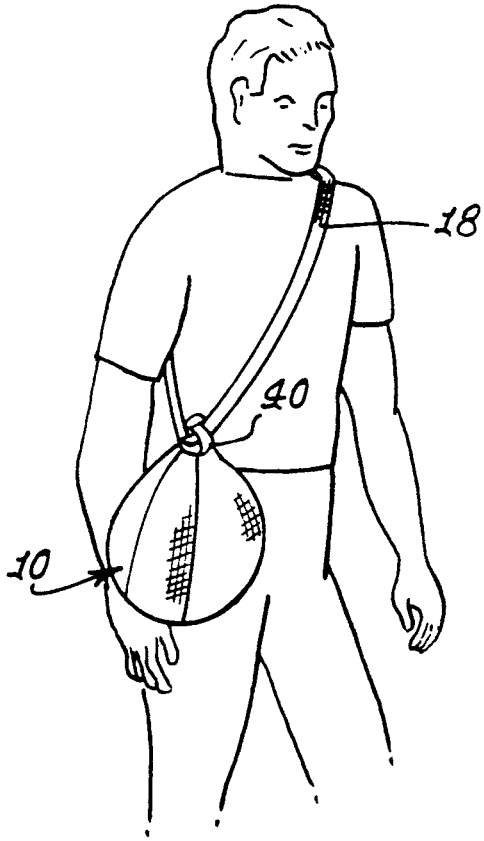
FIG. 1 is a perspective view of a wearer carrying the novel carrying sack with contained motorcycle helmet.

Turning to the drawings in detail:

The device of this invention is a holder designed and especially adapted for the carrying and storage of a motorcycle type helmet. The carrying sack, generally 10, is lined with a soft fabric inside 12 and with a tougher longer wearing fabric 14 outside which protects the helmet 16 while making it possible to easily sling or carry the helmet with one hand or slip the belt loop 18 over the shoulder or head and shoulders and wear it. The carrying sack 10 is preferably made of center piece 20, and opposed side pieces 22 and 24 which overlap at the top to form a closure. The surfaces of side pieces 22 and 24 at the closure are provided with interlocking areas or patches 26 which are made of the material sold under the trademark "Velcro" or some similar materials, all of which are readily available and familiar to those in the art. The side pieces 22 and 24 extend at one upper end 28 of the carrying sack 10 to form the elongated belt loop 18.

At the opposite upper end 30 of the carrying sack 10, the side pieces 22 and 24 extend upwardly only enough to form the small loop 32.

Figure 7:
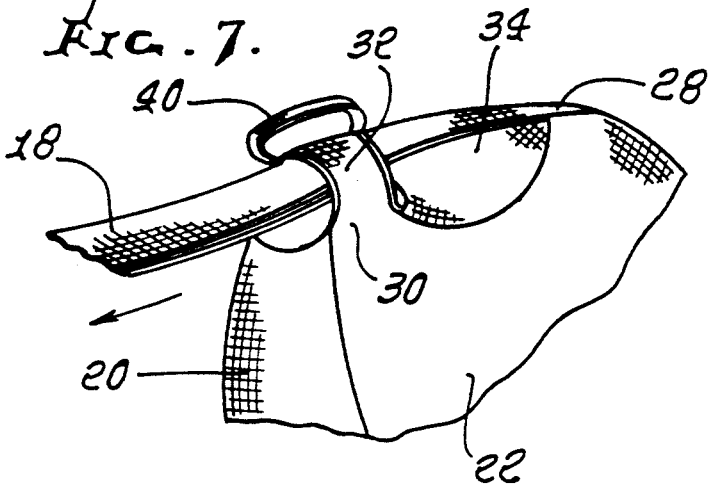
FIG. 7 is a partial perspective view showing the elongated upper loop passed through the smaller upper loop which is located at the opposite end of the sack.
Figure 2:
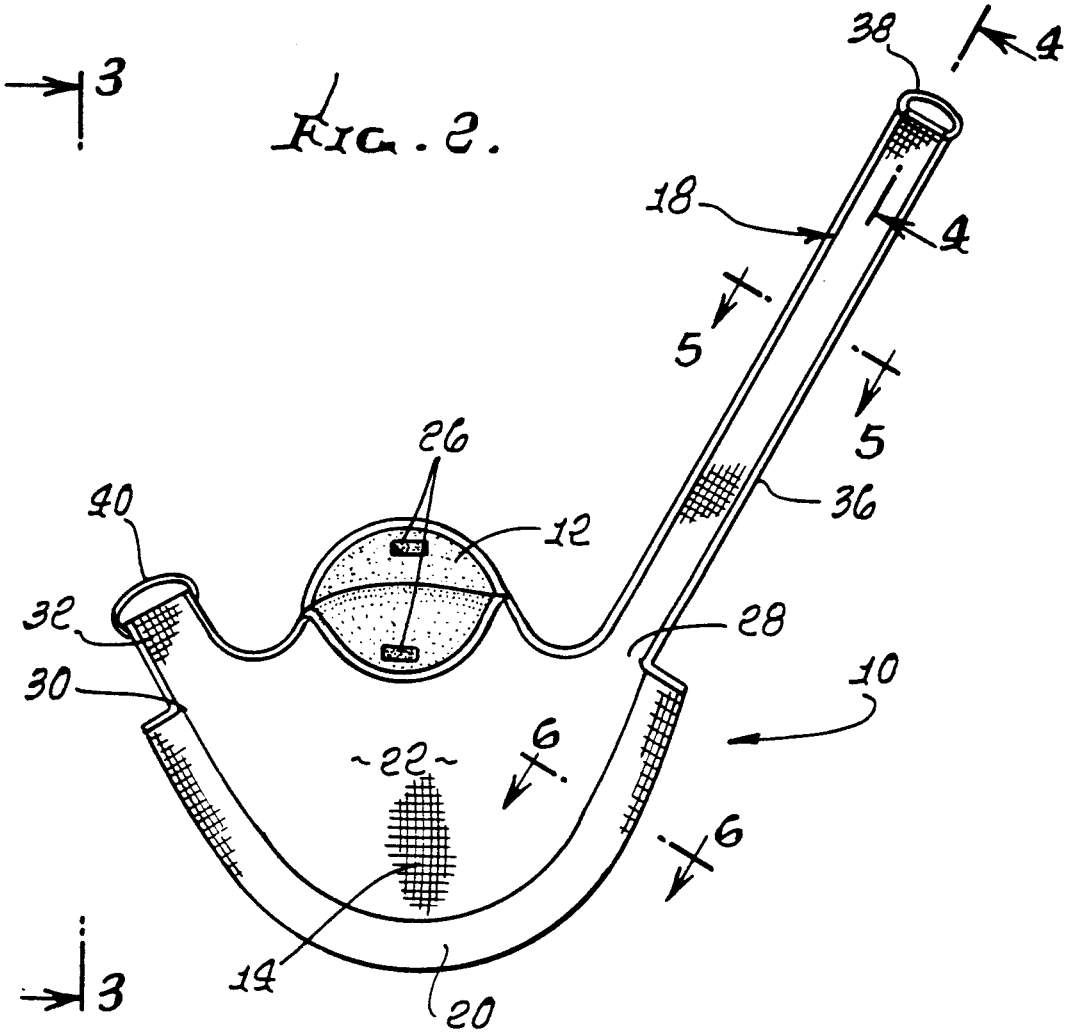
FIG. 2 is a side plan view of the carrying sack of this invention.
Figure 5:
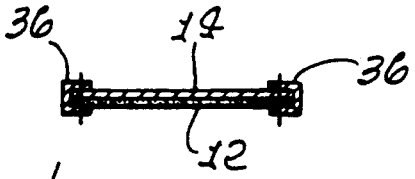
FIG. 5 is a sectional view taken along the line 5—5 in FIG. 2.
Figure 4:
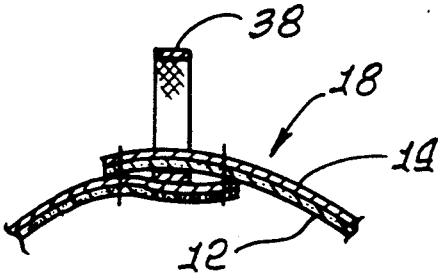
FIG. 4 is a sectional view taken along the line 4—4 in FIG. 2.
Figure 3:
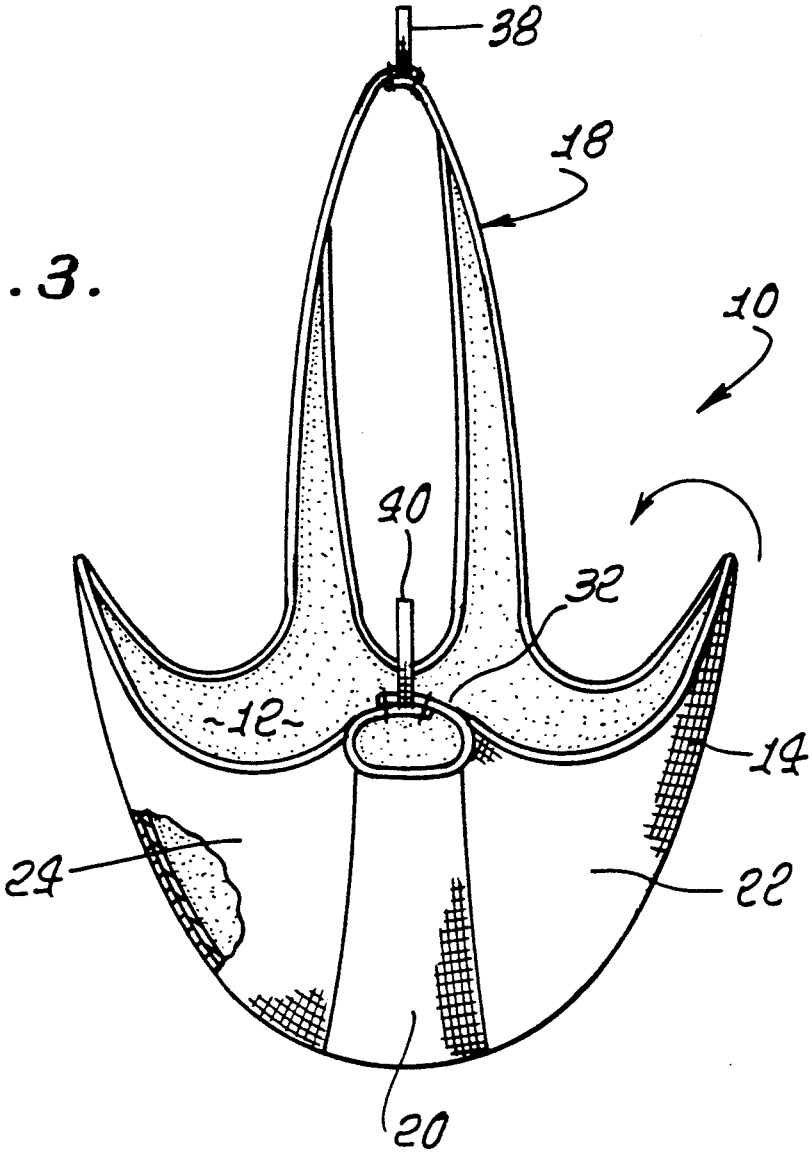
FIG. 3 is a view taken along the line 3—3 in FIG. 2.
Figure 8:
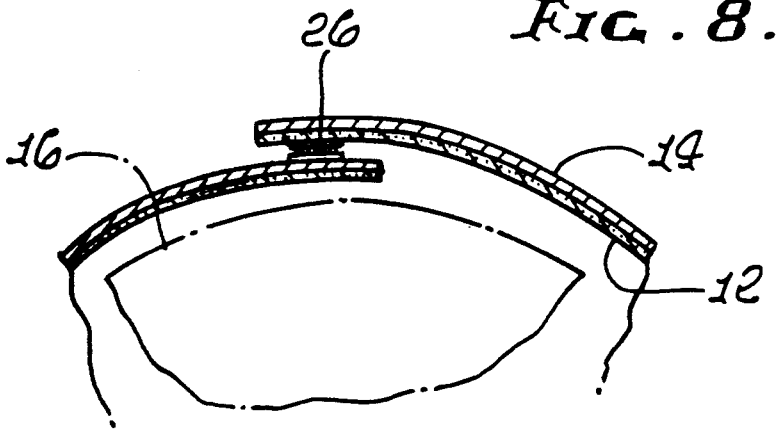
FIG. 8 is a partial sectional view of the side flaps when folded over to provide a closure over the helmet contained within the sack.

The overlapped closure is indicated generally by reference numeral 34 in FIG. 7.

Figure 1A:
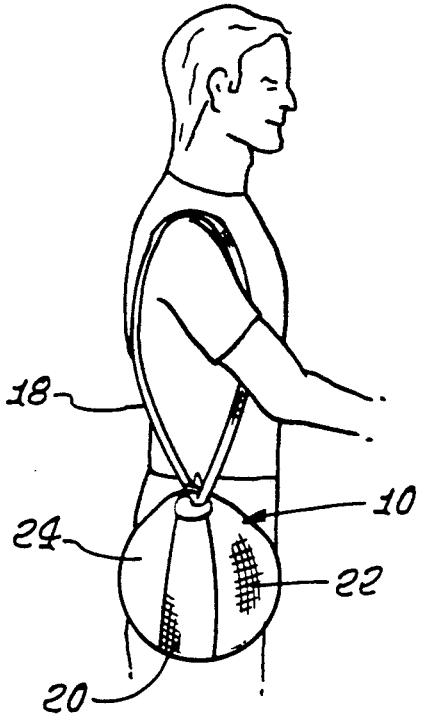
FIG. 1A is a side view of the carrying sack carried in another position.
Figure 6:
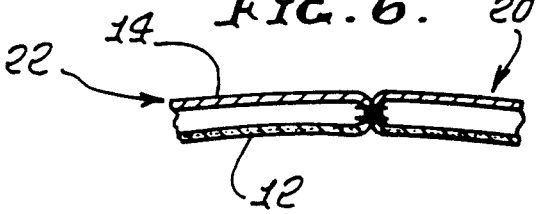
FIG. 6 is a sectional view taken along the line 6—6 in FIG. 2.

The inner and outer layers 12 and 14, respectively are joined by and sown to the edging 36. The elongated belt loop 18 is intended to be passed through small loop 32 while still leaving the loop 18 available and of a size such that the arm and shoulder or arm, shoulder and head can be passed through it as shown in FIGS. 1 and 1*a*.

Optionally, small loops 38 and 40 are provided. These small loops function as follows.

A strap (not shown) can, also be used for larger individuals to attach the sack strap loop 38 to the sack loop 40.

The sack is unique in that one end slips through the hole at the other end of the sac forming a protective pouch or sack. The soft interior protects the helmet from nicks and scratches while actually buffing up the helmet.

The soft fabric 12 is preferably a fleece-like material. The outer fabric 14 is preferably, canvas, denim or leather.

Having fully described the invention, it is intended that it be limited solely by the lawful scope of the appended claims.

I claim:

1. A novel protective carrying sack for a motorcycle helmet having a generally hemispherical shape comprising a pliable fabric body having a soft inside surface adapted to polish the surface of the helmet and an outer surface tougher than said inside surface, said body having a generally hemispherical shape and generally conforming to the shape of the shell of the motorcycle helmet and having opposed side flaps which overlap at the top over the helmet to form a closure and having at one upper end an elongated belt first loop portion, and at the opposite upper end a small second loop portion, said first loop portion being adapted to pass through said second loop portion, and said first loop portion being large enough to pass over the shoulder and under the arm of a wearer when being carried.

2. The combination of the carrying sack of claim 1 with a motorcycle helmet which is received within said carrying sack.

3. The carrying sack of claim 1 wherein the said opposed side flaps are provided with superimposed adherent closure maintaining areas.

* * * * *